United States Patent [19]

Berger et al.

[11] Patent Number: 4,526,296

[45] Date of Patent: Jul. 2, 1985

[54] FLEXIBLE PLEATED CONTAINER STRUCTURE

[76] Inventors: Richard F. Berger, 11 Teaneck Rd., Ridgefield Park, N.J. 07660; Greg Pardes, 425 E. 58th St., New York, N.Y. 10022

[21] Appl. No.: 510,159

[22] Filed: Jul. 1, 1983

Related U.S. Application Data

[63] Continuation of Ser. No. 328,147, Dec. 7, 1981, abandoned, which is a continuation of Ser. No. 81,929, Oct. 4, 1979, abandoned.

[51] Int. Cl.[3] ..... B65D 37/00

[52] U.S. Cl. ..... 222/107; 222/494

[58] Field of Search ..... 222/92, 95, 107, 215, 222/386.5, 494; 29/454

[56] References Cited

U.S. PATENT DOCUMENTS

| | | | |
|---|---|---|---|
| 3,187,639 | 6/1965 | Kelly et al. | 29/454 X |
| 3,235,135 | 2/1966 | Robert et al. | 222/107 X |
| 3,240,394 | 3/1966 | Modderno | 222/95 |
| 3,494,509 | 2/1970 | McGuire | 222/107 |
| 3,506,163 | 4/1970 | Rauh et al. | 222/215 X |
| 3,800,398 | 4/1974 | Harrington | 29/454 X |
| 4,139,665 | 2/1979 | Herrero | 222/107 X |

*Primary Examiner*—F. J. Bartuska

*Attorney, Agent, or Firm*—Toren, McGeady and Stanger

[57] ABSTRACT

A flexible, pleated container has a wall structure comprising a barrier component which renders the container wall structure impervious to oxygen and water vapor. The barrier component is substantially uniformly effective throughout the entire wall structure. In a preferred embodiment of the invention, the thickness of the wall structure gradually decreases towards the outer extremities of the pleats with the thinnest wall portion located at the apexes of the pleats. The barrier component, however, is maintained at substantially uniform thickness throughout the wall structure.

3 Claims, 11 Drawing Figures

FLEXIBLE PLEATED CONTAINER STRUCTURE

This is a continuation of application Ser. No. 328,147, filed Dec. 7, 1981, now abandoned, which is a continuation of application Ser. No. 081,929 filed Oct. 4, 1979, now abandoned.

FIELD OF THE INVENTION

The invention is directed to containers suitable for storing and dispensing flowable products susceptible to oxidative deterioration and/or biological contamination. The term "flowable" as used herein is deemed to include liquid, pasty, semi-solid and particulate products including emulsions and suspensions capable of being dispensed through a relatively narrow orifice or discharge opening.

The containers are made of polymers and/or elastomers, hereinafter sometimes collectively referred to as "plastics" or "plastic".

PRIOR ART

The closest prior art known to applicants is embodied in the following U.S. patents:

U.S. Pat. No.: 3,506,163
U.S. Pat. No.: 3,429,717
U.S. Pat. No.: 3,438,788
U.S. Pat. No.: 3,499,820
U.S. Pat. No.: 3,539,437
U.S. Pat. No.: 3,540,577
U.S. Pat. No.: 3,586,514
U.S. Pat. No.: 3,615,710
U.S. Pat. No.: 3,863,014
U.S. Pat. No.: 3,908,070
U.S. Pat. No.: 3,977,153
U.S. Pat. No.: 4,041,209
U.S. Pat. No.: 4,048,361
U.S. Pat. No.: 4,092,391
U.S. Pat. No.: 4,121,006
U.S. Pat. No.: 4,152,464

BACKGROUND INFORMATION

Many flowable products, such as certain foods, cosmetics and pharmaceuticals have a tendency gradually to spoil or deteriorate upon contact with the ambient atmosphere. This is primarily due to the oxygen and water vapor (hereinafter collectively referred to as "oxygen") contained in the atmosphere which have a deleterious effect on the products. Even if such flowable products are not completely spoiled, they oftentimes, upon prolonged contact with the atmosphere, assume a dry or crusty condition at their exposed surfaces which renders dispensing of the products more difficult, if not impossible.

In recent years a variety of so-called "barrier" materials has been proposed for use in container walls. These barrier materials render the container walls substantially impervious to oxygen or at least substantially reduce the penetration of oxygen into the interior of the container. Some of the many known barrier compositions are disclosed in the prior art referred to above. However, prior art container structures with barrier characteristics are relatively rigid and thick-walled. Attempts to provide such containers with flexible, relatively thin wall structures having satisfactory barrier characteristics have failed, since upon repeated flexing, the container walls tend to develop micro-cracks which, of course, reduce the barrier capability of the wall structure, thereby negating the barrier effect. This holds particularly true if the container is of the collapsible pleated or bellow type, such as disclosed in U.S. Pat. No. 3,506,163.

Pleated containers are usually manufactured from a prefabricated extruded parison or tubular plastic body which by way of blow molding, is formed into the pleated container shape. Since the parison has a uniform cross-sectional thickness, the thickness of the container at and near the extremities of the pleats is reduced as compared to the thickness at the remaining portions of the pleats. This is so because in the blow molding procedure, the wall forming parison material gradually thins out or necks down towards the extremities of the pleats, the thinnest wall portion being at the outer apexes of the pleats. If the parison contains barrier material, the amount of barrier material is then insufficient at the thin extremities of the pleats effectively to prevent penetration of oxygen into the interior of the container.

The terms "pleated" or "bellows" as used herein refers to containers that are flexible in one direction but substantially rigid in the direction transverse to said one direction and include containers wherein the pleats or bellows collapse when sufficient product has been dispensed.

OBJECTS OF THE INVENTION

It is the primary object of the present invention to provide a pleated, flexible container for storing and dispensing flowable products whose entire wall structure is effectively impervious to oxygen.

It is another object of the invention to provide an improvement and modification of the type of container disclosed in U.S. Pat. No. 3,506,163, the contents of which are expressly incorporated herein.

THE PRIOR U.S. PAT. No. 3,506,163

The starting point for the present invention is the teaching of prior U.S. Pat. No. 3,506,163 (hereinafter referred to as the '163 patent), the present invention, as stated, being an improvement and modification of the invention of the '163 patent. With a view to facilitating appreciation and understanding of the present invention, the disclosure of the '163 patent is set forth in the following, at length.

The '163 patent states that its invention relates to articles (containers) for holding and dispensing flowable materials. For example, the article of the '163 patent may be used to hold and dispense materials such as syrups of all types, toothpaste, shampoo, peanut butter, catsup, mustard, etc. However, the article is not limited to use with pasty, highly viscous materials of this type and can be used with liquids such as concentrated solutions of edible products.

The '163 patent characterizes the problem to be overcome as follows:

"One of the problems encountered with articles for holding and dispensing materials of the above type is that such products tend to spoil as a result of oxidation resulting from contact between these materials and the outer atmosphere. Even where the materials are not subjected to spoilage, they can assume a dry, crusty condition at their exposed surfaces creating considerable inconvenience and often rendering further dispensing of the materials impossible to carry out. A further problem encountered with known articles of this type is the tendency of the contents thereof to drip and spill. Also, there often is no way of knowing how much of the material remains within the article, so that one can unexpectedly run out of the material.

In the case of collapsible containers, it is impossible with known constructions to achieve a condition where substantially the entire contents of the container have been discharged therefrom, so that a considerable amount of the material is always wasted because it is retained in the container when the latter is discarded. In addition, reuse of such collapsible containers is not possible, and containers which can withstand pressure variations, which will not break if frozen, and which are of light weight and low cost have not been satisfactorily achieved up to the present time."

The objects of the '163 patent read as follows:

"It is accordingly a primary object of the present ('163) invention to provide an article of the above general type which will avoid the above drawbacks.

In particular, it is an object of the ('163) invention to provide an article of the above general type which is capable of maintaining material such as foodstuffs in the interior of a container out of contact with the atmosphere to protect this material against the effects of the atmosphere.

A further object of the present ('163) invention is to provide for an article of the above type a normally closed, self-opening discharge spout which when the article is not used to discharge contents therefrom will automatically close to seal off the material within the article from the outer atmosphere.

Furthermore, it is an object of the present ('163) invention to provide a structure of the above type which will not expand back to its initial configuration, so that the extent to which the article is collapsed is an indication of the extent to which it is filled.

Furthermore, it is an object of the present ('163) invention to provide a collapsible container which has a construction which enables substantially all of the contents in the interior of the container to be discharged therefrom.

Yet another object of the present ('163) invention is to provide a construction which is of light weight, which can withstand substantial pressure variations, which will not break, even if frozen, and which can be manufactured at low cost.

Also, the objects of the present ('163) invention include a method for manufacturing a discharge spout for an article of the above type."

The '163 patent then states the summary of its invention:

"In accordance with the ('163) invention the article includes a collapsible container means capable of collapsing from an initial expanded position toward a collapsed position while undergoing a reduction in volume. A discharge spout means is connected to and in communication with the container means to discharge a flowable material from the interior thereof, and this discharge spout means has a normally closed position and is pressure-responsive in the sense that it responds automatically to a reduction in the volume of the container means to discharge material therefrom. At the end of any given increment of reduction in the volume of the container means, the spout means automatically reassumes its closed position, due to the inherent resiliency of the spout means, and as a result the material in the container and in the interior of the spout means itself is prevented from communicating with the outer atmosphere so as to be protected therefrom. At the same time, the container cannot expand back to its initial position, so that it remains in a partly collapsed position indicating the extent to which the container is filled."

The drawings of the '163 patent which are reproduced in the drawings of the present application and labelled "prior art" are described as follows:

"The ('163) invention is illustrated by way of example in the accompanying drawings which form part of this application and in which.

DESCRIPTION OF THE PREFERRED EMBODIMENTS

Figure 3:
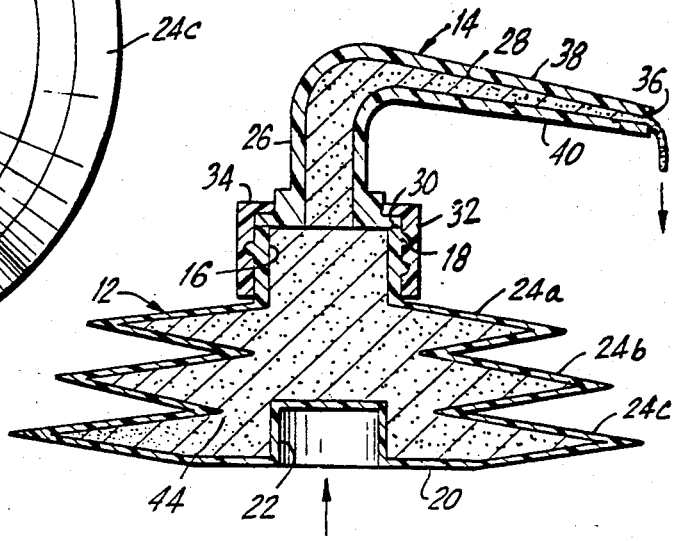
(PRIOR ART) FIG. 3
FIG. 3 is a sectional elevation taken along line 3—3 of FIG. 1 in the direction of the arrows and showing the article in a partly collapsed condition.

Referring now to the drawings and to FIGS. 1–4 in particular, it will be seen that the structure of the ('163) invention illustrated in FIGS. 1–4 is in the form of an article 10 made up of two primary units, namely, a container means 12 and a spout means 14. The container means 12 is collapsible and is made of any desired plastic material such as polyvinyl chloride, polyethylene, or the like. This material of which the container means 12 is formed is flexible and may also be resilient. The container means 12 is formed with an open top end 16 in the form of a cylindrical neck having exterior threads 18 molded integrally therewith. Opposite to its open top end, the container means 12 has a closed bottom end 20 provided with a protuberance 22 which also may be molded integrally with the sheet material from which the collapsible container means 12 is molded. This protuberance 22 may be hollow, as indicated in FIG. 3. The neck 16 and the protuberance 22 have a common axis which coincides with the central axis of the container means 1.

Surrounding this central axis of the container means 12 are a plurality of annular bellows portions **24*a*, 24*b*, and 24*c*. These annular bellows portions 24*a*–24*c* are of V-shaped cross-section and they are intergrally joined with each other in the manner shown in FIG. 3, while the end annular bellows portions 24*a* and 24*c* are integrally joined with the neck 16 and the closed end 20, as is also indicated in FIG. 3. Although only three bellows portions are indicated in the illustrated example, any desired number of these bellows portions may be provided for the container means 12** of the invention.

Figure 1:
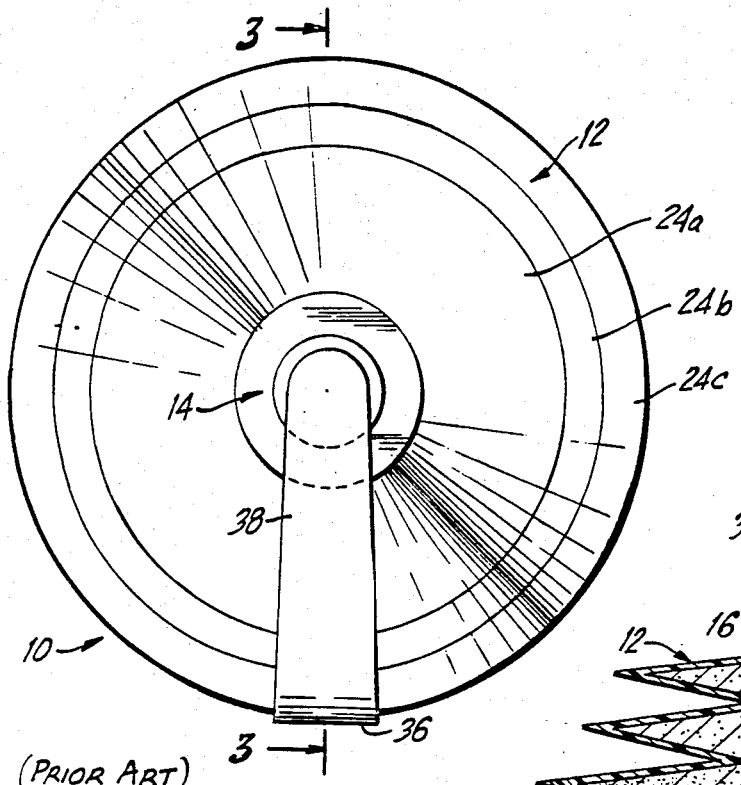
(PRIOR ART) FIG. 1
FIG. 1 is a top plan view of an article according to the present ('163) invention.
Figure 2:
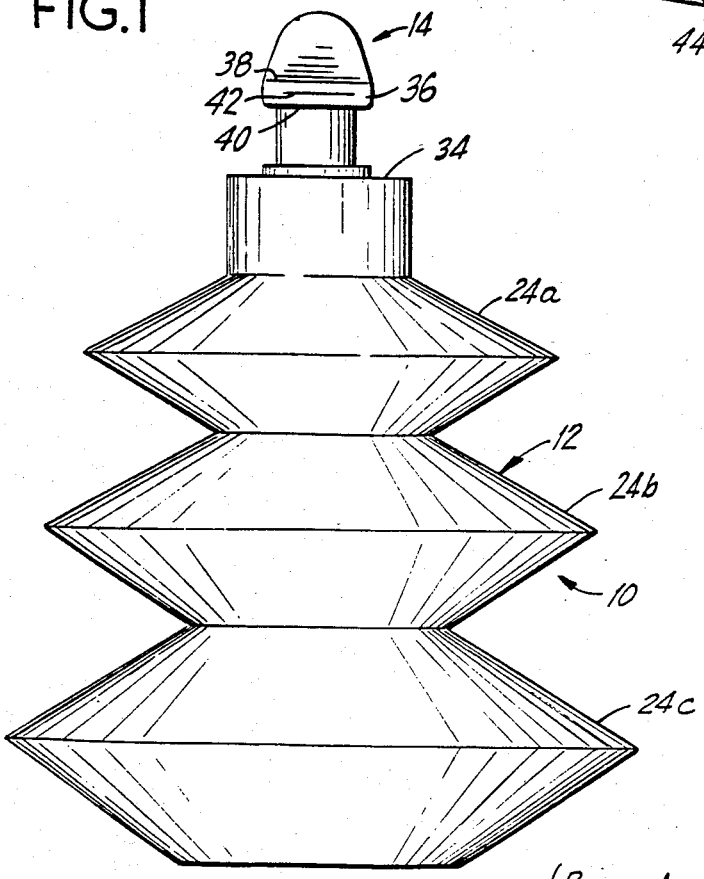
(PRIOR ART) FIG. 2
FIG. 2 is a front elevation of the article as seen when looking toward the discharge tip of a spout thereof.

It will be noted that with the structure illustrated in FIGS. 1–3, the successive bellows portions **24*a*–24*c* are of progressively increasing diameters from the upper open end 16 toward the lower closed end 20 of the container means 12**.

The spout means 14 is also made of a moldable plastic material such as polyvinyl chloride, polyethylene, polypropylene, or the like, and the composition of the plastic used for the spout means 14 is such that it has elastomeric properties. As is apparent particularly from FIG. 3, the spout means 14 is of substantially L-shaped configuration having one leg 26 which communicates with the interior of the container means 12 at its open end 16 and a second leg 28 which is substantially perpendicular to the leg 26. At its open end 26, the spout means 14 has an outwardly directed flange 30 formed integrally with the tubular leg 26 and engaging the exterior top and surface of the neck 16."

It will be appreciated that the description of the '163 patent quoted in the preceding paragraph, actually refers to a spout 14 of approximately shaped configuration having a zone 26 which communicates with the interior of the container 12 at its open end 16 while another zone 28 is appropriately shaped for dispensing purposes, the zone 28 also contributing to the pleasing appearance of the container structure.

The description of the drawings of the '163 patent continues as follows:

"A cap nut 32 of the spout means 14 has at its top end an inwardly directed flange 34 engaging the flange 30, and the nut 32 is formed with internal threads which receive the thread 18, so that through the nut 32 it is possible to fix the spout means 14 to the collapsible container means 12 in a fluid-tight manner as indicated in FIG. 3. The nut 32 may be made of the same plastic material as the container 12.

Distant from its permanently open end which communicates with the neck 16, the spout means 14 has a normally closed discharge end 36. This discharge end 36 is defined between a pair of flat elastic wall portions 38 and 40 which are joined together at their outer side edges and which resiliently press against each other in the normal closed position of the spout means 14. The leg 28, however has the walls 38 and 40 thereof gradually displaced apart from each other to an increasing extent from the normally closed discharge end 36 toward the junction with the leg 26 which is of a tubular cylindrical configuration, as is apparent from FIGS. 1–3. Thus, it will be seen that the spout means 14 has an axial tubular leg portion 26 coinciding with the central axis of the container means 12 and a radial tubular leg portion 28 extending radially from and forming an extension of the axial portion 26, this radial portion having a length sufficiently great to locate the discharge end 36 at the region of the outer periphery of the container means 12 at an elevation higher than the latter. The flat resilient top and bottom walls 38 and 40 which gradually approach each other and the side walls which interconnect these top and bottom walls provide for the radial tubular portion 28 a substantially rectangular cross section the height of which gradually diminishes toward the discharge end 36 from which a ribbon of the flowable material will discharge.

According to a method of the invention the spout means 14 may be manufactured in four steps. In the first step the spout is cast in a blow-molding machine, but initially it is longer than the finished spout and the discharge end is closed for the purpose of permitting the molding operations to be carried out. Moreover, at this time this discharge end is only partially flattened. The molded casting is heated in a second step of the method of manufacture of the spout only to an extent sufficient to shape the material of the casting, not enough to cause the material to stick to itself. Then in a third step of the method, that area which is to form the discharge end 36 is pinched with cooling jaws and held between the latter until the plastic is cool enough to retain the new flattened shape in which it sets as a result of the cooling produced by the jaws and as a result of the flattened condition of the walls 36 and 40 at the discharge end 36 resulting from the action of the cooling jaws. This cooling step takes place in a matter of seconds with the aid of a blast of air or water. In the final step of the method, after the properly shaped spout has been removed from the cooling jaws, the closed or blind end thereof is cut off "-(although this section may be formed independently)-" so as to leave the spout with the flattened walls 38 and 40 at the discharge end 36, these walls defining between themselves a slit or interface 42 (FIG. 2) where the walls engage and press against each other due to their elastic properties.

Figure 4:
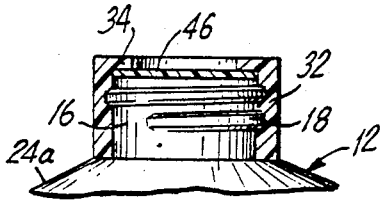
(PRIOR ART) FIG. 4
FIG. 4 is a fragmentary partly sectional elevation of the manner in which the container is closed before a spout is joined thereto.

The container means 12 may initially be filled with any flowable material 44 schematically indicated in FIG. 3, when the container means 12 is initially purchased, the spout means 14, except for the cap nut 32, may be separate from the remainder of the assembly, and the structure can at this time have the condition shown in FIG. 4. Thus, as may be seen from FIG. 4 the container means 12 is closed by way of a separate closure disc 46 which is pressed against the top surface of the neck 16 by the inwardly directed flange 34 of the cap nut 32. In this way the containers can be conveniently packed and shipped with the spouts initially separate from the cap nut 32. Also it is possible with such an arrangement to repeatedly use one spout means with a series of containers as the latter are purchased.

Initially the container means 12 will have a maximum volume somewhat as indicated in FIG. 2, and the flowable material 44 will fill the container all the way up to the sealing disc 46 shown in FIG. 4. When the article is purchased the operator will remove the cap 32 and simply discard the disc 46. The cap 32 is then assembled with the remainder of the spout means 14 simply by extending the legs 28 and 26 through the space surrounded by the flange 34 until the flange 30 engages the flange 34, and now the parts can be assembled to have at the neck 16 the condition shown in FIG. 3."

It will be appreciated that the embodiment in which a sealing disc is utilized, is only applicable with reuseable containers. From a practical point of view, the container body will normally be permanently affixed to the cap during the filling process, so as to avoid refilling in a non-sterile environment. "Now the operator will compress the container means 12 so as to reduce the volume thereof from the initial volume, such as that indicated in FIG. 2, toward a minimum volume which the container means 12 has when fully collapsed. As the volume of the container means 12 diminishes the material 44 therein will flow out to the spout means 14, displacing air out of the latter in advance of the material 44. The spout means 14 is pressure-responsive in the sense that during a reduction in the volume of the container means 12 the walls 38 and 40 automatically move apart from each other in response to the increased pressure of the flowable material to open the discharge end 36 while the material 44 discharges in the form of a ribbon, where a semi-solid material is used, through the slit 42 which is now open.

As soon as the operator terminates the reduction in the volume of the container means 12, the resilient walls 38 and 40 resume their closed position closing the discharge end 36, as a result of the inherent resiliency of the material of the spout means 14 and because the material 44 is either liquid or semi-solid and thus readily yields to the elastic pressure of the walls 38 and 40. Because the sheet material which forms the container means 12 is resilient, this container means tends to expand when the operator terminates the reduction in the volume of the container means 12. This tendency of the container means 12 to expand creates a suction at the spout 14 causing its walls to collapse inwardly toward each other so as to provide a very tight closure in the gradually tapering discharge end of the spout, in a manner preventing any exposure of the material which would cause the latter to drip, to become encrusted, or to be deleteriously affected in any way. Thus, the interior of the container means 12 and the spout 14 is fluid-tightly closed off from the outer atmosphere, and the container means 12 cannot expand back toward its initial volume because any tendency toward such expansion results in a suction causing the outer atmosphere only to press the walls 38 and 40 more tightly against each other. In this way the container means 12 remains in its partially collapsed condition, after some of the material has been removed therefrom, so that a simple glance at the container means of the invention will indicate the extent to which the latter is filled with the material 44.

Furthermore, the material 44 is reliably protected against the effects of the outer atmosphere, so that it remains fresh and flavorful and is not subjected to spoilage. These are very important considerations for foodstuffs, for example. Even when dealing with non-edible products, as, for example, toothpaste, the article 10 of the invention will prevent any dry encrustations from forming on an exposed surface of the material, so that it is always in a fluid condition ready to be used whenever the container means 12 is compressed.

Not only is the article 10 of the invention suitable for use with pasty, semi-solid materials, in addition it can be used with all types of liquids, and this is of particular importance in the case of concentrated solutions of edible products. For example soups or juices can be provided in concentrated solutions in the article of the invention and the flavor, freshness, and aroma of such concentrated edible solutions will be reliably retained until substantially all of the contents are discharged because of the fact that the contents are reliably maintained out of contact with the outer atmosphere. For example, in the case of coffee, it is possible to situate in the article 10 of the invention a concentrated coffee solution which will reliably maintain its full aroma and flavor because it is not exposed to the outer atmosphere, so that simply by providing a small reduction in the volume of the container means 12, a given small amount of such concentrated coffee solution can be deposited in a cup, for example, to have boiling water added thereto in order to achieve in this way an instant coffee from a liquid concentrate without risking any loss in the quality of the coffee as a result of the deterioration in the qualities of the concentrate.

It is furthermore to be noted that the article of the invention can be frozen, for example, without risking any breakage, because of the flexibility and resiliency of the materials used. In addition, it is clear that the article of the invention can be very inexpensively manufactured.

It is to be noted that as the volume of the container means 12 diminishes, the neck 16 approaches the protuberance 22 and the annular bellows portions **24*a*–24*c*** become located closer to each other at their outer crests.

Because of the progressively increasing diameters of these outer crests, it is possible for the bellows portion **24*a* to nest within the bellows portion 24*b* and for the bellows portion 24*b* to nest within the bellows portion 24*c*, so that the extent to which the material 44 can be displaced out of the interior of the container means 12 is greater than would be the case if the bellows portions were all of the same diameter. In addition, since the configuration of the protuberance 22 closely matches that of the inner surface of the neck 16, as the latter approaches the closed end 20 it will be axially displaced along the protuberance 22 which thus serves to displace the material 44 out of the neck 16 itself and into the spout means 14. Thus, in this way also the extent to which the material 44 is displaced out of the article 10** is increased.

When the container means 12 assumes its fully collapsed condition, the entire article 10 can simply be discarded and a new one used in the manner described above, or it is possible to remove the spout means 14 and attach it to a new container means 12 which may be purchased in the condition indicated in FIG. 4 described above. However, it is also possible after removing the spout means 14 again to fill the container means 12 since it can be used repeatedly, so that the user of the article can repeatedly refill the container means 12 and make repeated use of the structure of the invention.

Figure 5:
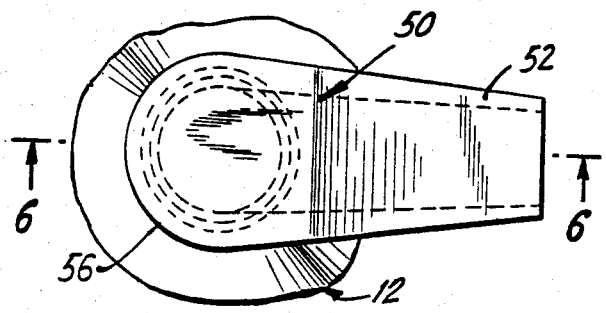
(PRIOR ART) FIG.5
FIG. 5 is a fragmentary top plan view of another embodiment of a spout of the ('163) invention.
Figure 6:
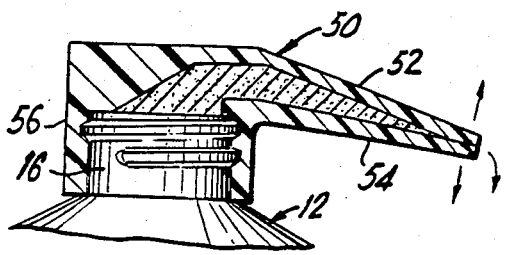
(PRIOR ART) FIG.6
FIG. 6 is a longitudinal sectional elevation taken along line 6—6 of FIG. 5 in the direction of the arrows.

Referring now to FIGS. 5 and 6, the embodiment of the invention which is illustrated therein is provided with a container means 12 identical with that of FIGS. 1–4. However, in this case the spout means 50 is of a different construction in that it does not require a cap nut 32. This spout means 50 may be manufactured in the manner described above in connection with the spout means 14 and operates in precisely the same way. It has walls 52 and 54 corresponding to the walls 38 and 40, respectively, and functions in exactly the same way to achieve the results set forth above in connection with FIGS. 1–3.

However, in the case of FIGS. 5 and 6, the permanently open leg 56 which corresponds to the leg 26 is formed with internal threads so as to be directly received on the neck 16 of the container means 12, in the manner shown most clearly in FIG. 6, so that in this way the use of a separate cap nut is not required and, of course, when the container means 12 is initially filled in a factory, for example, a simple closure can be provided over the neck 16 and it is not necessary to use a sealing disc 46 and cap nut 32 as shown in FIG. 4. On the other hand, the spout means 14 on the same container means 12, and this interchangeable use may be of interest in some cases. The spout means 50 is advantageous, in certain respects, with respect to the spout means 14 in that the spout means 50 is composed of fewer parts, it has a smaller overall height, and the flat top surface thereof permits stacking. However, the spout means 14 is itself of an exceedingly simple and effective construction so that it can be used wherever features such as stacking, small overall height, and number of parts are not of particularly great importance. The cost of the spout means 14 will generally be less than the cost of the spout means 50.

Figure 7:
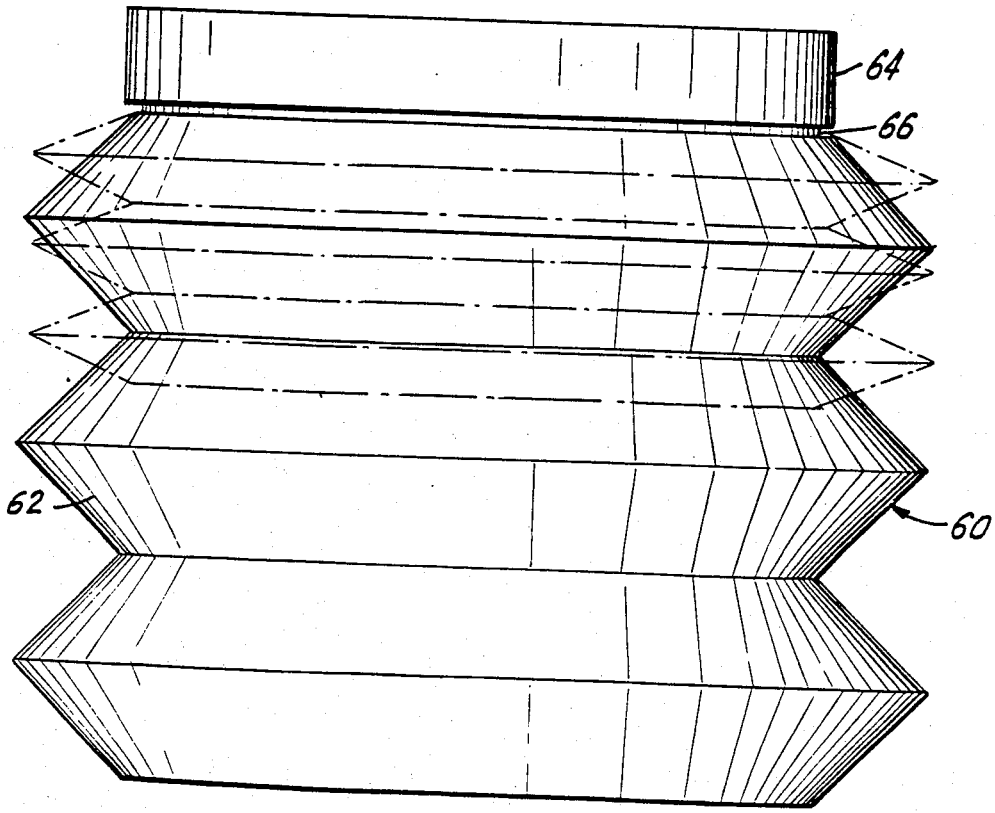
(PRIOR ART) FIG.7
FIG. 7 is an elevation of another embodiment of a container in a partly collapsed condition in dot-dash lines".

In the embodiment of the invention which is illustrated in FIG. 7, a container means 60 which corresponds to the container means 12 is provided, and in this case, the several bellows portions 62 thereof are of the same diameter so that a substantially cylindrical container means 60 is achieved. Such a construction may be preferred for use as a collapsible refrigerator jar, for example, capable of being collapsed beyond the partly collapsed condition indicated in dot-dash lines in FIG. 7. This jar is simply closed by a removable cap 64 which is threaded onto the cylindrical neck 66 which in this case is of a relatively larger diameter so that a wide-mouthed jar structure is provided, as may be more suitable for cerain home uses. With this construction, it is only necessary to replace the cap 64 with a spout such as the spout means 50 of FIGS. 5 and 6 where this spout means is provided with an open internally threaded end of the same diameter as the neck 66 to receive the latter. Thus, it is clear that the article of the invention can be adapted to a wide range of different uses, as is apparent from a comparison of the spout means 50 with the spout means 14 and a comparison of the container means 60 with the container means 12."

SUMMARY OF THE PRESENT INVENTION

Briefly, and in accordance with the present invention, pleated, flexible containers, such as disclosed in the '163 patent, are rendered impervious to oxygen by providing a barrier component containing wall structure, the amount of barrier component being sufficient to prevent penetration of oxygen therethrough, throughout the entire wall structure including at the thinner wall portions at the extremities of the pleats.

This is accomplished by providing a barrier component in the wall structure whose barrier capability is substantially uniformly effective throughout the wall structure, including at the thinner extremities of the pleats.

From a practical point of view, the uniformity of the barrier capability throught the wall structure may be achieved by providing a multi-layer wall structure, at least one of the layers consisting of or comprising the barrier component. The barrier component layer has properties such that—upon blow moulding a multi-layer parison into the desired pleated shape—the barrier component layer does not substantially thin out or thins out to a substantially lesser degree than the other layers of the multi-layer structure. In this manner, the thickness of the barrier component layer at the extremities will be substantially the same than that at the remaining portions of the wall structure. This result is readily accomplished if the melt viscosity of the barrier component layer is greater than the melt viscosity of the other layers of the structure. Due to the increased melt viscosity of the barrier component layer, it has a lesser tendency to flow or neck-down upon blow molding than the other layers, thereby obtaining a greater amount of barrier material at and near the extremities of the pleats in relation to the amount of material of the other layers. Experiments have indicated that in this manner, a pleated container structure is obtained which contains an amount of barrier material at and adjacent the extremities sufficiently effective to prevent penetration of oxygen through the wall structure. Due to the proportionally larger amount of barrier component at the areas where micro-cracks have a tendency to form upon flexing, the barrier capability of the container is preserved throughout its life. The melt index should be at least 1.5 times greater for the barrier component layer than for the other layers.

The object of the invention is thus most expeditiously accomplished by blow molding a parison formed from an extruded multi-layer structure, for example, a three-layer structure, wherein the oxygen absorbing layer is the center layer and has a higher melt viscosity value than the two adjacent layers. The adjacent layers may also contain barrier material. Moreover, it is within the scope of this invention to provide several oxygen absorbing layers. During the blowing of this multi-layer parison structure, the reduction in cross-sectional thickness of the oxygen absorbing barrier layer or layers at the extremities of the pleats—where the pleats have their largest diameter—is then less than of the other outer layers. As a practical matter, there is no or only slight reduction.

The outer layers may be formed of any suitable plastic material which can readily be flexed such as, for example, thermoplastic polyesters or other low gas permeability materials.

Considered from another aspect, the different layers of the parison may have different elastic modulus values whereby the same result may be obtained. In the latter case, the elastic modulus value for the barrier component layer should be lower than for the other layers.

It has been found that excellent results are obtained if, at the same temperature of blowing, the melt index of the central barrier layer or layers is at least 1.5 times higher than that of the adjacent outer layers.

DESCRIPTION OF THE DRAWINGS OF THIS INVENTION

Figure 8:
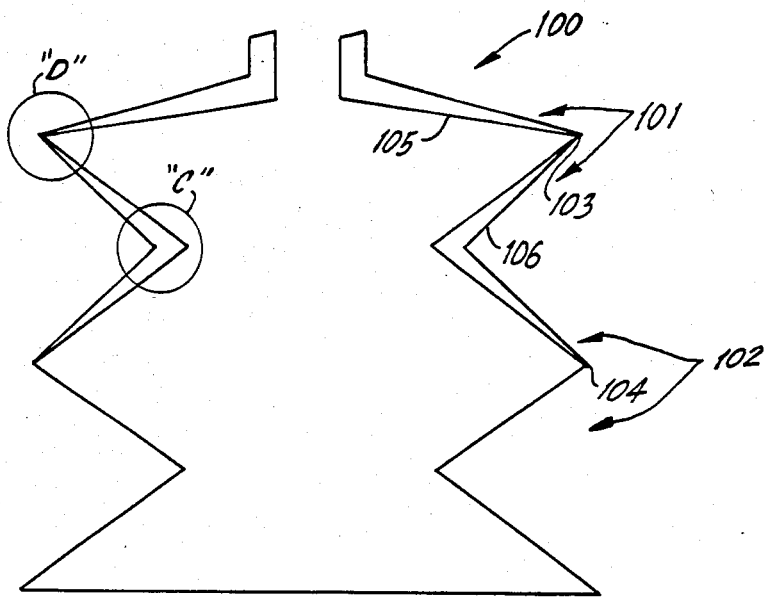
Figure 9:
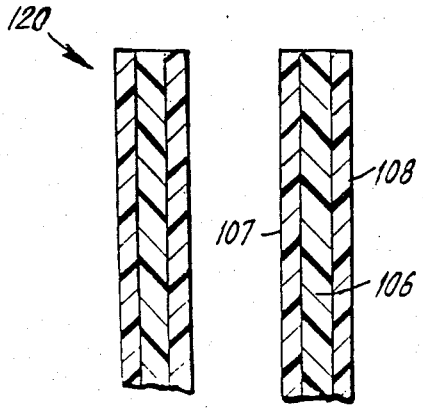
Figure 10:
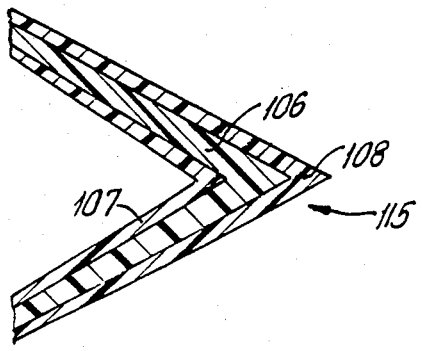
Figure 11:
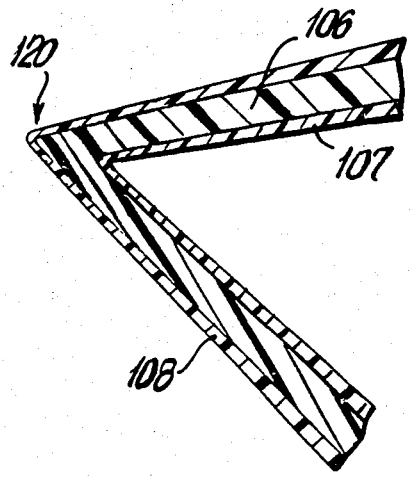

FIG. 8 is a fragmentary cross-sectional view, essentially corresponding to FIG. 3 of the '163 patent, showing the gradually decreasing layer thickness of the pleated wall structure of the container in a somewhat exaggerated manner;

FIG. 9 is a fragmentary cross-sectional showing of a parison to be used in the manufacture of one embodiment of a container according to the present invention; and FIGS. 10 and 11 are enlarged cross-sectional views of the encircled areas "C" and "D" of FIG. 8 as adapted to a container construction blow molded from the parison of FIG. 9.

FIG. 3 of the '163 patent shows the wall structure of the container as having a substantially uniform thickness throughout the container wall including at the extremities of the pleats or bellows. The showing of FIG. 3 does not correspond to the actual facts if the container of FIG. 3 is blow molded from a parison. As previously stated, blow molding is generally effected with a prefabricated extruded parison, the wall thickness of the parison obviously thinning out or necking down towards the extremities of the pleats during the blow molding procedure. The thinnest portion is thus at the outer apex of the pleats.

FIG. 8, in a somewhat exaggerated manner, shows the dimensional configuration of the wall structure of a blow molded pleated container corresponding to FIG. 3. The container, generally indicated by reference number 100, comprises a number of pleats, e.g., 101 and 102, whose wall thickness gradually decreases toward the apexes or extremities 103 and 104, so that the walls at and near the extremities are thinner than at the remaining portions. This is due to the blow molding manufacturing process in which the extruded prefabricated parison of substantially uniform cross-sectional thickness, thins out towards the extreme portions of the pleats. One of the extremity portions of the pleated container 100 of FIG. 8 is indicated by the encircled area "D" while the transition zone between the two pleats 101 and 102 is indicated by the encircled area "C".

Turning now to FIG. 9, a fragmentary portion of a parison is shown which may be used in accordance with the invention. The parison 120 in the embodiment of FIG. 9 comprises a three-layer structure, to wit, a central layer 106, an inner layer 107—which ultimately will be the product contacting layer—and an outer layer 108. The three layers are joined or fused in sandwich fashion and form the integral tubular body or parison 120. Each of the layers 106, 107, 108 is made of plastic, to wit polymeric and/or elastomeric material and is of a composition suitable for the intended purpose. While the layers 107 and 108 may contain barrier material, in the present embodiment, the barrier component or oxygen absorber is the layer 106, to wit, the central layer. It should be emphasized that the layers 106, 107 and 108 may be of any suitable composition well-known in the art and applicants do not intend to be limited to any specific composition. However, for purposes of example, layer 107 may consist of polyethylene layer. 108 may consist of PPL (polypropylene) and layer 106, to wit, the barrier component layer, may consist of any of the compositions disclosed in the various prior art patents previously referred to. In the present embodiment, this layer consists of PVC or PET. The multi-layer structure 106, 107 and 108 has been coextruded from three separate tubular structures as is well known in the art.

In accordance with the invention, the barrier component layer 106 has a higher melt viscosity than that of the layers 107 and 108. When the parison of FIG. 9 is blow molded into a pleated container, for example, of the shape shown in FIG. 8, the dimensional configuration at the portions "D" and "C" of FIG. 8, will then correspond essentially to that shown in FIGS. 10 and 11, respectively, it being appreciated that these showings are somewhat exaggerated and diagrammatical. Since the layer 106 has a higher melt viscosity than the layers 107 and 108, the blow molding causes less flow of the layer 106 so that the thickness of the layer 106 at and near the extremity portions 115 and 120 is substantially the same or only insignificantly reduced as compared to that of the remaining portions of the layer. By contrast, the layers 107 and 108 have a greatly reduced thickness at the extremity 115 and 120. It will be noted that at the transition zone between the two pleats 101 and 102, as indicated by the letter "C" in FIG. 8—which corresponds to the area 115 in FIG. 10—the amount of barrier material 106, in fact, is increased relative to the amount in the remaining portions. Since the container is subject to substantial wear at the extreme portions 111 and 115 due to repeated flexing of the container, the inventive provision of sufficient barrier material at these areas overcomes the effect of any microcracks that may be formed. The container will retain its capability to prevent penetration of oxygen throughout its life.

It should be appreciated that although a single barrier component layer 106 has been shown, a plurality of such layers could be provided. Moreover, the adjoining layers 107 and 108 may also contain barrier component and any number of such layers may be provided.

In essence, therefore, due to the different melt viscosity values, a differential "necking down" occurs at the high blow ratio sections of the pleats or bellows. Although, these sections have a thinner cross-section than the low blow ratio sections, the amount of oxygen absorber is proportionally larger than at the thick sections, thereby significantly reducing the necking down effect.

It should also be appreciated that the same effect is accomplished by using layers 106, 107 and 108 having different elastic moduli, the elastic modulus value for the barrier layer (106) being lower than that for the adjoining layers. The modulus can be altered in the desired manner by using fillers, such as fiber-glass and the like. Two different polymers may be used, such as polyethylene/polysulfone. Another combination is thermoplastic polyester/polycarbonate.

The dispensing spout structure to be used in the inventive container construction may be of the same type as employed in the prior '163 patent. Generally, the dispensing structure should preferably be of peristaltic nature in order to prevent accumulation of product within the discharge conduit forming space of the dispensing valve structure. This is particularly so if flowable products are to be dispensed which are in liquid suspension or paste form with particulate matter suspended in the liquid phase. In order to prevent accumulation of particulate material within the dispensing structure—which might negatively affect the sealing action of the dispensing mechanism—the dispensing area has to be cleared of such particulate material so as to assure reliable functioning of the valve. by providing a peristaltic type of movement, the valve lips are squeezed together in a reliable manner. It will be appreciated that such peristaltic action may be accomplished in a number of different ways.

The valve may thus be associated and cooperate with an integral valve cleaning means which may be in the form of a pair of rollers running along the exterior surface of the valve, or a pair of curved ribbon springs may be arranged within the dispensing portion of the spout-valve arrangement.

The dispensing spout structure should contain sufficient barrier component so as to render the structure impervious to oxygen. It has been found that excellent results are obtained if the container wall structure and the dispensing spout structure are made of different plastic materials, or of the same material but with different physical properties.

While the invention has been described in connection with several embodiments, it will be appreciated by those skilled in the art that modifications and/or alterations may be made within the scope of the invention. Concerning the embodiments of the prior '163 patent, as set forth herein at length, the manufacturing and end user procedures set forth in the prior art Patent may also be varied. Thus, for example, the spout structure may be fabricated with an open end and may be mechanically clamped prior to its initial use. Further, the spout or cap structure could be permanently affixed to the container body proper. In respect of the shape or configuration of the dispensing valve, this may be designed so as to satisfy both technical and aesthetic demands.

Furthermore, it should be emphasized that the dispensing spout structure could be placed at any convenient or suitable location and orientation of the container body. Expressions, such as, "the top of the container", and "the bottom of the container", have, of course, relative meanings only, dependent on from where the container is viewed. Thus, when reference to "top" has been made, this can also mean "bottom" and vice versa.

What is claimed is:

1. A blow-molded, flexible dispensing container suitable for storing and dispensing products that are subject to oxidative-type deterioration comprising:

a. an at least partially pleated container wall structure of plastic material, said wall structure being flexible in one of its axial and radial directions and substantially rigid in the other one of said directions and having incorporated therein oxygen and water vapor barrier material in an amount sufficient to make the entire wall structure essentially impervious to oxygen and water vapor, said wall structure comprising a plurality of integrally connected superimposed layers, at least one of said layers having incorporated therein said oxygen and water vapor barrier material, said wall structure being slightly thinner at and near the extremities of the pleats than at the remaining portions of the pleats, the amount of oxygen and water vapor barrier material at said thinner portions being substantially the same than the amount incorporated in the remaining wall portions of the pleats; and b. a dispensing spout structure connected to said wall structure and communicating with the interior of the container, said dispensing spout structure also being essentially impervious to oxygen and water vapor and being normally closed, said spout structure having pressure responsive discharge means which automatically open upon flexing of said wall structure to permit discharge of product therethrough, said discharge means automatically closing again when flexing of said wall structure is discontinued.

2. A container, as claimed in claim 1, wherein said wall structure comprises at least three integrally connected layers, at least the center layer having incorporated therein said oxygen and water vapor barrier material, said central layer having a greater melt viscosity value than the melt viscosity value of the other layers.

3. A container as claimed in claim 1, wherein said wall structure comprises at least three layers integrally connected to each other, at least the center layer having incorporated therein said oxygen and water vapor barrier material, the amount of said barrier material at and near the extremities of said pleats being at least as large as in the remaining portions of said pleats, said center layer having a lesser elastic modulus value than that of the other layers.

* * * * *